US006286397B1

(12) United States Patent
Taggart et al.

(10) Patent No.: US 6,286,397 B1
(45) Date of Patent: Sep. 11, 2001

(54) MULTI-PURPOSE TOOL

(75) Inventors: John Merrick Taggart, Cromwell; A. Jeffrey Turner, Madison; Edward S. Richardson, Fairfield, all of CT (US); Daniel J. Nelsen, Providence, RI (US); Stephen E. Lane, Jamestown, RI (US); Marc Harrison, *deceased*, late of Portsmouth, RI (US), by Diana R. Harrison, legal representative; Aidan J. Petrie, Providence, RI (US)

(73) Assignee: Swiss Army Brands, Inc., Shelton, CT (US)

( * ) Notice: Subject to any disclaimer, the term of this patent is extended or adjusted under 35 U.S.C. 154(b) by 0 days.

(21) Appl. No.: 09/338,931

(22) Filed: Jun. 23, 1999

Related U.S. Application Data

(60) Provisional application No. 60/090,350, filed on Jun. 23, 1998.

(51) Int. Cl.[7] ..... B25B 13/46; B26B 11/00

(52) U.S. Cl. ..... 81/63.1; 81/440; 81/177.4; 7/118; 7/142; 7/168

(58) Field of Search ..... 81/440, 439, 177.4, 81/60–63.2; 7/118, 165, 168, 119, 138, 142

(56) References Cited

U.S. PATENT DOCUMENTS

| | | | |
|---|---|---|---|
| D. 336,415 | 6/1993 | Cheng . | |
| D. 368,634 | 4/1996 | Frazer . | |
| D. 371,498 | 7/1996 | Lai . | |
| D. 380,362 | 7/1997 | Rivera . | |
| D. 382,182 | 8/1997 | Seber et al. . | |
| D. 382,190 | 8/1997 | Blackston et al. . | |
| D. 384,872 | 10/1997 | Yeh . | |
| D. 385,168 | 10/1997 | Rivera . | |
| 4,238,862 | 12/1980 | Leatherman . | |
| 4,269,311 | 5/1981 | Rich | 206/234 |
| 4,744,272 | 5/1988 | Leatherman . | |
| 4,805,303 | 2/1989 | Gibbs . | |
| 4,854,045 | 8/1989 | Schaub . | |
| 4,856,132 | 8/1989 | Burns et al. . | |
| 4,888,869 | 12/1989 | Leatherman . | |
| 4,918,775 | 4/1990 | Leu . | |
| 5,062,173 | 11/1991 | Collins et al. . | |
| 5,142,721 | 9/1992 | Sessions et al. . | |
| 5,251,351 | 10/1993 | Klotz . | |
| 5,251,353 * | 10/1993 | Lin . | |
| 5,267,366 | 12/1993 | Frazer . | |
| 5,313,376 | 5/1994 | McIntosh . | |
| 5,320,004 | 6/1994 | Hsiao | 81/440 |
| 5,421,225 | 6/1995 | Chen | 81/490 |
| 5,450,775 | 9/1995 | Kozak | 81/440 |
| 5,495,942 | 3/1996 | Izhak | 206/372 |
| 5,562,553 | 10/1996 | Digerness et al. . | |
| 5,661,908 | 9/1997 | Chen . | |
| 5,664,274 | 9/1997 | Collins . | |
| 5,689,886 | 11/1997 | Yeh . | |
| 5,697,114 | 12/1997 | McIntosh et al. . | |
| 5,711,194 | 1/1998 | Anderson et al. | 81/440 |
| 5,802,936 | 9/1998 | Liu | 81/450 |
| 5,927,164 | 7/1999 | Anderson et al. | 81/440 |
| 6,119,560 * | 9/2000 | Anderson et al. | 81/440 |

FOREIGN PATENT DOCUMENTS

| | | |
|---|---|---|
| 0 776 737 A1 | 6/1997 | (EP) . |

* cited by examiner

*Primary Examiner*—D. S. Meislin
(74) *Attorney, Agent, or Firm*—Pennie & Edmonds LLP

(57) ABSTRACT

A portable multi-purpose tool including tools useful for fixing or adjusting equipment used by a persons engaged in in-line skating, a board sport, and the like. The multi-purpose tool includes various implements that are conveniently stored within a tool housing, and are selectively extendable from the tool housing into respective operating positions. At least one of the tools is a socket wrench configured to engage and apply torque to an element to be rotated. The socket wrench may include a ratchet mechanism for controlling the direction in which torque may be applied by the socket.

18 Claims, 8 Drawing Sheets

MULTI-PURPOSE TOOL

CROSS-REFERENCE TO RELATED APPLICATION

This application claims priority of U.S. provisional patent application Serial No. 60/090,350, filed Jun. 23, 1998, which application is hereby incorporated by reference in its entirety.

BACKGROUND OF THE INVENTION

1. Field of the Invention

The present invention relates to multi-purpose tools. More particularly, the invention relates to such tools that provide several useful items to assist a person in performing a number of different functions including functions associated with the use of sports equipment.

2. Description of the Prior Art

A number of less traditional sports have become quite popular with many people in the United States and in many other parts of the world. These rapidly emerging sports include those involving boards upon which the person rides and performs tricks and other maneuvers. Examples include skateboarding, snowboarding, and wakeboarding. In addition, another sport that is becoming increasingly popular is in-line skating.

In the cases of skateboarding/snowboarding and in-line (or roller) skating, a person requires either a board on which the person rides, or a pair of skates, which the person wears on his or her feet. As is well known, a skateboard includes a pair of trucks mounted to the underside of the board, the trucks including respective axles that rotatably carry wheels at the respective ends of the axles. The trucks are mounted to the underside of the board by plural bolts and nuts, and the wheels are rotatably mounted on the axles by threaded nuts that engage respective threaded portions of those axles. Over time, these nuts can become loose and require tightening. Furthermore, as is well known to persons who ride skateboards, in many instances it is desirable to either tighten or loosen the nuts to a certain degree depending upon the type of riding in which the person will be engaged. Some types of riding call for a relatively loose connection between the board and trucks, while other types of riding demand a tighter connection.

Snowboards and wakeboards include adjustable bindings that are mounted onto the respective boards by bolts and nuts, which also may become loose over time. In addition, depending on the type of ride the user desires, the bindings can be adjusted. In the case of snowboards, the respective bindings for the front and back feet can be moved to adjust the relative angle between the binding and the board, depending on a rider's preferences.

In-line skates typically include four aligned wheels mounted to the bottom of a boot-like device that a person wears on his or her feet. The wheels are engaged to the boot by plural threaded nuts that threadedly engage complementary threaded portions of the skate. These nuts can become loose over time, causing an uncomfortable ride or even resulting in a potentially dangerous condition should one or more of the wheels become disengaged from the skate.

Due to the nature of these sports, a person will often be far from home when the need arises to tighten or loosen a bolt or a nut. For example, people often travel many miles on in-line skates or skateboards, and could be stranded if a wheel should happen to fall off of their in-line skate or skateboard. Thus, there exists a need for a compact tool to perform these functions and that can be conveniently carried by the rider without interfering with the person's riding.

A number of multi-purpose tools have been proposed. For example, U.S. Pat. No. 5,062,173 to Collins et al. and U.S. Pat. No. 5,664,274 to Collins disclose tools including a plurality of implements for performing cutting and other functions. However, neither of those multi-purpose tools includes the requisite tools for performing the necessary functions associated with the sports mentioned above, and, therefore, are unacceptable for such applications.

Accordingly, it will be apparent that there continues to be a need for a multi-purpose tool that provides various implements for performing many functions associated with sports equipment such as used during skateboarding, snowboarding, wakeboarding, and in-line skating. Furthermore, the need exists for such a device that is relatively compact so that it does not in any way hinder or burden a person who is engaged in such sports. The present invention addresses these needs and others.

SUMMARY OF THE INVENTION

Briefly, and in general terms, the present invention provides a compact, portable multi-purpose tool for use by a person engaged in a board sport, in-line skating, and the like, to perform various tasks performed on equipment associated with those sports. The multi-purpose tool of the present invention includes various implements that are conveniently contained in a housing, and are selectively extendable from the housing into respective operating positions for use. Due to the compact nature of the tool, the tool may be readily carried to any location, without the tool being a burden or hindrance to the person carrying the tool during engagement in a particular sport.

Preferably, the multi-purpose tool of the preset invention includes a housing and at least one wrench coupled to the housing for selective displacement between a storage position and an operating position. Additional tools or implements useful during engagement with a sport as described above may also be coupled to the tool housing. For example, a socket wrench may be coupled to the housing for selective movement between a storage position and a working position. A pivotable bit-holding socket configured to removably support a bit, such as for storage, may also be coupled to the housing for movement between a storage position and a working position.

These and other features and advantages of the present invention will be readily apparent from the following detailed description of the invention, taken in conjunction with the accompanying drawings which illustrate, by way of example, features of the present invention.

DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENT

Figure 1:
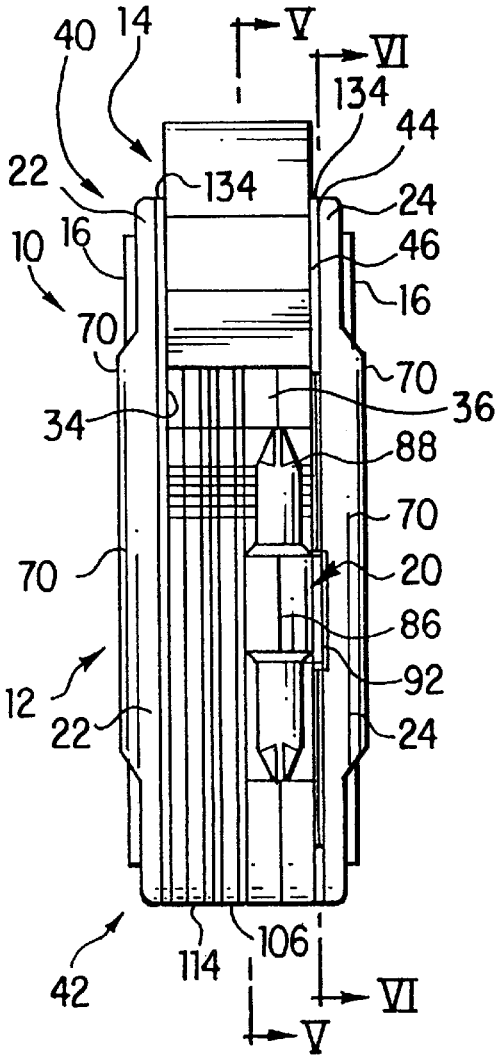
FIG. 1 is a right side elevational view of a first embodiment of a multi-purpose tool formed in accordance with the principles of the present invention.
Figure 2:
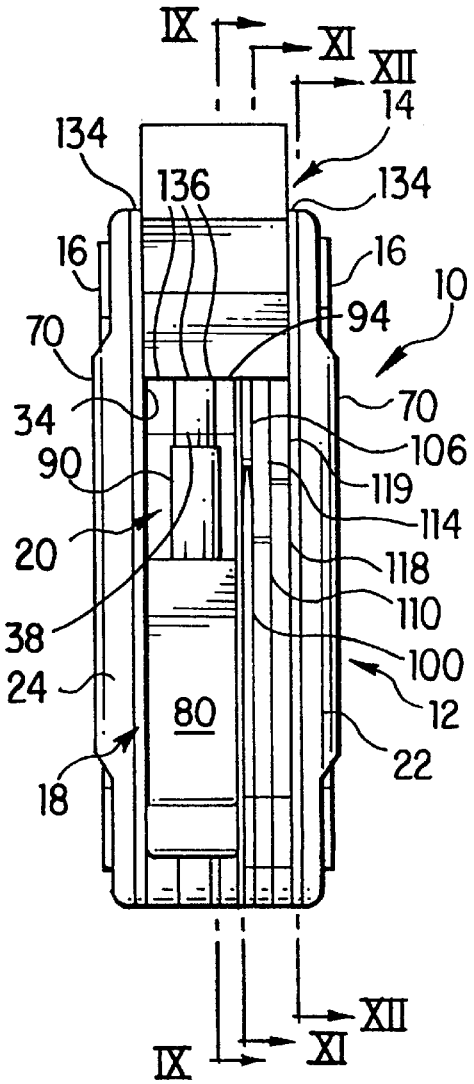
FIG. 2 is a left side elevational side view of the tool of FIG. 1.
Figure 3:
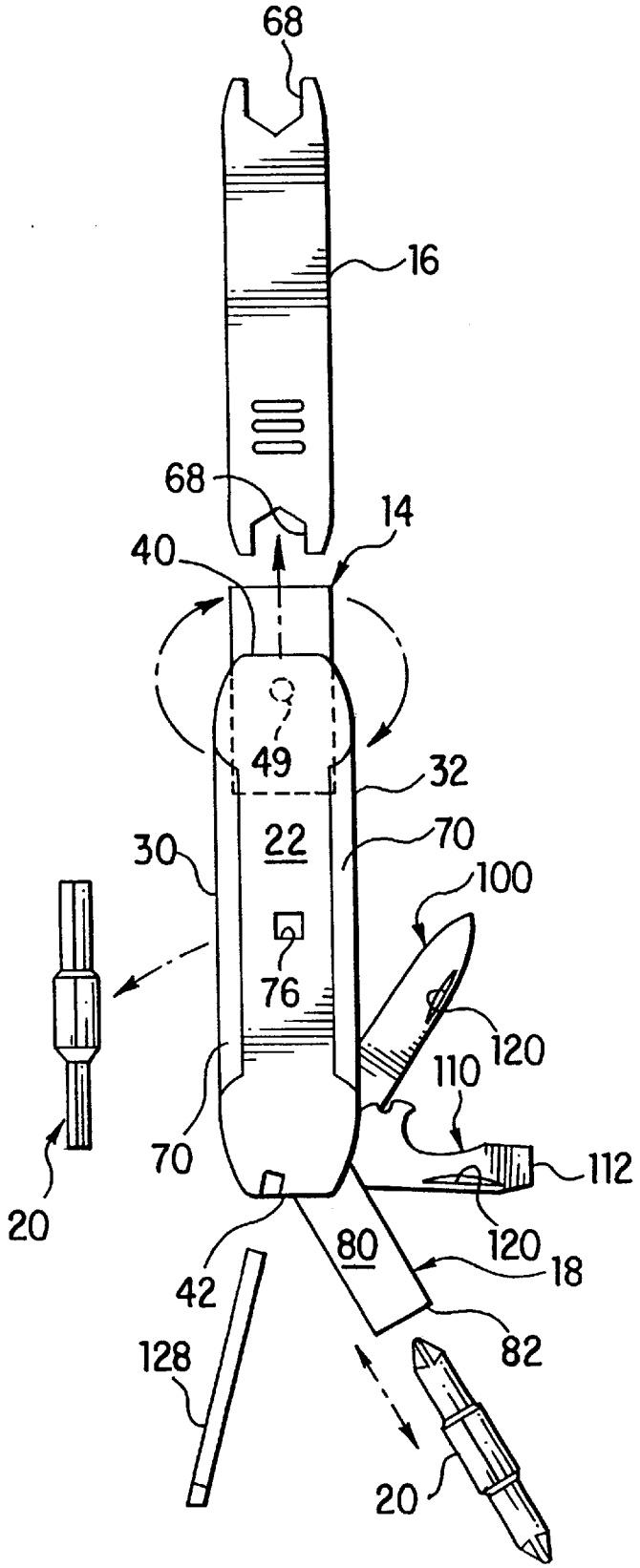
FIG. 3 is a partially exploded front elevational view of the tool of FIG. 1.

In the following detailed description, like reference numerals will be used to refer to like or corresponding elements in the different figures of the drawings. Referring now to FIGS. 1 and 2, there is shown a first embodiment of a multi-purpose tool 10 formed in accordance with the principles of the present invention, multi-purpose tool 10 having a plurality of additional tools coupled thereto, as shown in FIG. 3, selected for performing various functions associated with equipment for sports such as snowboarding, skateboarding, in-line skating, and the like. The multi-purpose tool comprises a compact, low profile housing 12 configured to house various tools or implements that are useful in connection with those sports. In a preferred embodiment, housing 12 is formed with a plurality of recesses shaped to receive the tools or implements to be housed by the housing. For example, a rotatable socket wrench 14, one or more removable crescent wrench bars 16, and a pivotably mounted bit driver 18 configured to releasably engage various bits 20 may be provided.

Housing 12 includes a front cover plate or scale 22 and a back cover plate or scale 24, each of which is preferably elongated, with a generally rectangular cross section. Housing 12 defines a pair of longitudinal sides 30 and 32, each of which includes a longitudinal opening 34 leading to respective recesses 36 and 38 within housing 12 in which one or more implements or tools may be stored, as described in greater detail below. Housing 12 also includes a pair of ends 40 and 42 (preferably having at least rounded corners), at least one end (end 40 in the FIGS.) including an opening 44 that leads to a recess 46 inside the housing. Housing 12 may include a number of additional plates interposed between respective front and back cover plates 22, 24 and formed with predetermined cross-sectional shapes such that housing 12 includes the respective recesses for receiving implements, as described in greater detail below. The respective plates 22, 24 of housing 12 are preferably joined together by spaced apart rivets 48 that extend through the respective plates 22, 24, and any additional plates therebetween. Some of the rivets, in addition to securely holding the plates together, serve as pivot pins for various pivotably mounted implements, as described below. The rivets that do not serve as pivot pins are preferably 2.5 mm in diameter, while the rivets that act as pivot pins are preferably 4 mm in diameter to provide additional strength for the pivotable mounting.

Figure 4:
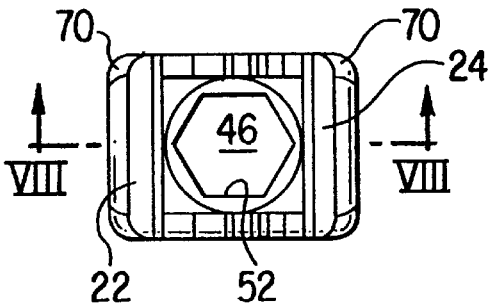
FIG. 4 is a top end view of the tool of FIG. 1.

In a preferred embodiment, multi-purpose tool 10 includes a socket wrench 14 pivotably mounted for rotation within recess 46. Socket wrench 14 preferably is pivotably mounted to housing 12 via one of rivets 48 which also acts as a pivot pin, the pivot pin extending through a central opening 49 formed in socket wrench 14, as shown in FIG. 3. Socket wrench 14 is preferably in the form of an open-ended cylinder 50, with each end 51*a*, 51*b* defining a respective hexagonal socket 52*a*, 52*b*, as shown in FIG. 4. Rotation of socket wrench 14 about its pivot pin permits selective orientation of socket wrench 14 for use of the socket 52*a*, 52*b* at one end thereof. The sockets are preferably formed with different dimensions to accommodate the sizes of conventional nuts used on various sports equipment, such as those described herein. In one embodiment, one of the sockets is formed with a ½ inch diameter (to serve, for example, as a skateboard truck socket and wake board thumb screw), while the other socket is formed with a 9/16 inch diameter (to serve, for example, as a wheel socket). Socket wrench 14 may be further formed with an opening in the cylindrical side wall (not shown) configured to receive a hook of a wrist strap or the like so that the tool 10 may be carried on a person's wrist.

Figure 6:
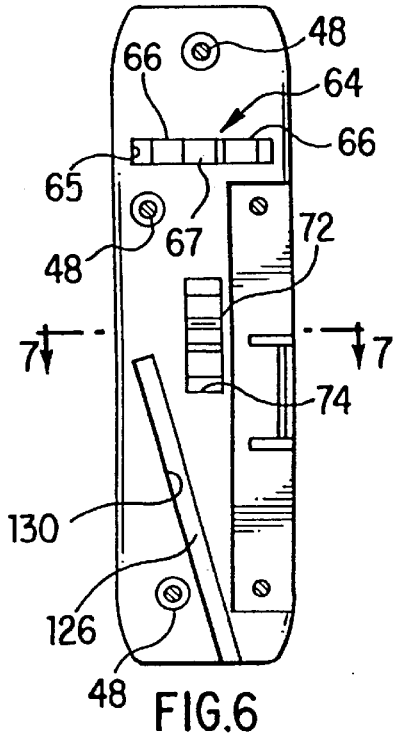
FIG. 6 is a cross-sectional view taken along the line VI—VI of FIG. 1.
Figure 8:
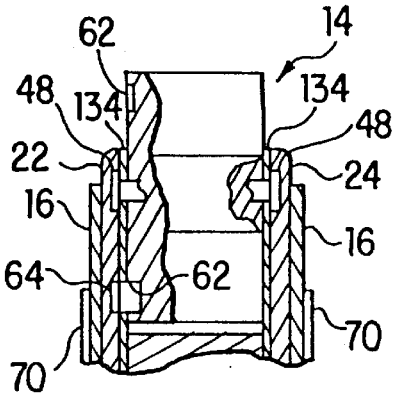
FIG. 8 is a cross-sectional view taken along the line VIII—VIII of FIG. 4.
Figure 9:
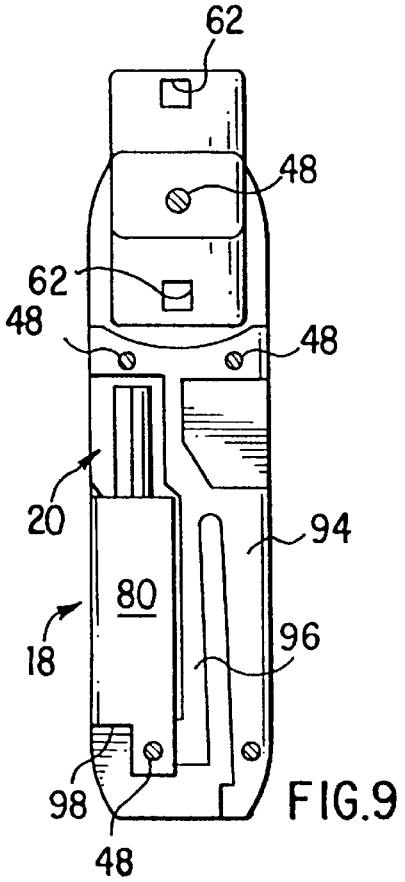
FIG. 9 is a cross-sectional view taken along the line IX—IX of FIG. 2.

As shown in FIGS. 8 and 9, socket wrench 14 preferably further includes a pair of recesses or openings 62 formed on the outer cylindrical wall thereof, preferably adjacent opposite longitudinal ends 51*a*, 51*b* of socket wrench 14. Complementary socket spring 64 is mounted within tool housing 12 at a predetermined location, preferably in a seat 65 on the inside surface of front cover plate 22, as shown in FIG. 6, to releasably engage one of respective recesses 62 when one of sockets 52*a*, 52*b* is facing away from housing 12. Socket spring 64 of FIG. 6 includes a pair of flange portions 66 extending in opposite directions from a flexible, curved central portion 67 that projects inwardly into housing 12 to engage one of respective recesses 62. It will be appreciated that any other releasable locking mechanism may be used to releasably retain socket wrench 14 in a desired position by engaging socket wrench 14. Thus, socket wrench 14 may be releasably locked in either of two positions, with a respective one of sockets 52*a*, 52*b* facing away housing 12 in a working position in which socket 52*a*, 52*b* may engage a nut or bolt (or other element shaped to fit within socket 52*a*, 52*b*), and the other of sockets 52*a*, 52*b* within recess 46.

The multi-purpose tool 10 preferably further includes one or more removable crescent wrenches in the form of elongated bars 16, as shown in FIGS. 1 and 3. Wrench bar 16 preferably includes a plurality of cut-outs or shaped recesses defining open-sided wrench portions 68. Each wrench portion 68 preferably comprises a plurality of sides (preferably four) of preferably approximately equal length, preferably with adjacent sides defining a 120° angle therebetween. In one illustrative embodiment, wrench bar 16 includes a plurality of wrench portions 68, each of which is formed with predetermined dimensions to accommodate the sizes of conventional nuts or sided elements utilized on various sports equipment. For example, wrench portions 68 may have cross-sectional dimensions of, respectively, 10 mm, 11 mm, and ⅜ inch or any other desired dimensions. In an alternative embodiment, tool 10 includes two such bars, each of which includes respective wrench portions 68 at opposite longitudinal ends thereof, as shown in FIG. 3. For example, one wrench bar may include 7⁄16 inch and ⅜ inch wrench portions, while the other bar includes 9 mm and 10 mm wrench portions.

In one illustrative embodiment, wrench bar 16 is carried by housing 12 within a wrench bar receptacle (not shown) that is pivotally coupled to housing 12 via of rivets 48. The receptacle includes an opening through which the pivot pin is extended in order to pivotally mount the receptacle to housing 12. The receptacle is hollow and includes an open distal end configured to receive wrench bar 16. Thus, the receptacle and the wrench bar 16 may be pivoted to a retracted position for storage in recess 36. In the retracted position, wrench bar 16 is sandwiched between the lower end of the receptacle and the upper end of the recess 36, and in that manner is securely held within multi-purpose tool 10. The receptacle and wrench bar 16 may also be pivoted out of recess 36 to an extended position from which wrench bar 16 may be removed from the receptacle by simply pulling wrench bar 16 away from housing 12 until wrench bar 16 clears the open distal end of the receptacle. Conversely, in order to replace wrench bar 16 in the receptacle, wrench bar 16 is aligned with the open distal end of the receptacle and is advanced into the receptacle. The receptacle may then be pivoted back to the retracted position with wrench bar 16 nested and stored in recess 36.

Figure 7:
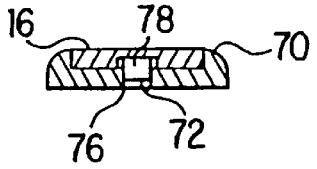
FIG. 7 is a cross-sectional view taken along the line VII—VII of FIG. 6.
Figure 12:
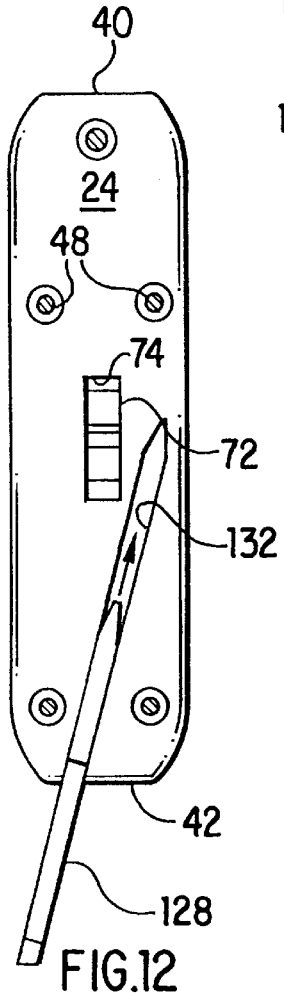
FIG. 12 is a cross-sectional view taken along the line XII—XII of FIG. 2.

In an alternative embodiment, multi-purpose tool 10 includes two such wrench bars 16 that are slidably received on multi-purpose tool 10 outwardly of respective front and back cover plates 22 and 24 (shown in FIGS. 1 and 2). In such embodiment, cover plates 22, 24 may be formed with longitudinally extending, inwardly projecting opposing pairs of flanges 70 which cooperate with the faces (as shown in the FIGS., the exterior faces, however, flanges 70 may be formed on interior faces instead) of cover plates 22, 24 to define respective receptacles therebetween sized to slidably receive respective wrench bars 16. In addition, a pair of wrench springs 72 preferably are received in respective seats 74 formed on the interior faces of cover plates 22, 24, as shown in FIG. 12. Wrench springs 72 may be similar in construction to socket spring 64, and include flexible, curved central portions that extend through respective openings 76 (FIG. 3) formed in cover plates 22, 24 for receipt in complementary recesses 78 (FIG. 7) formed in wrench bars 16 to releasably lock wrench bars 16 in place. It will be appreciated that any other releasable locking mechanism may be used to releasably retain wrench bar 16 in a desired position by engaging wrench bar 16.

In one embodiment, wrench bar 16 is also preferably formed with a curved cut-out so that the wrench bar may be used as a conventional cap lifter, with the cut-out defining a concave segment configured to engage and remove a standard bottle cap.

Figure 5:
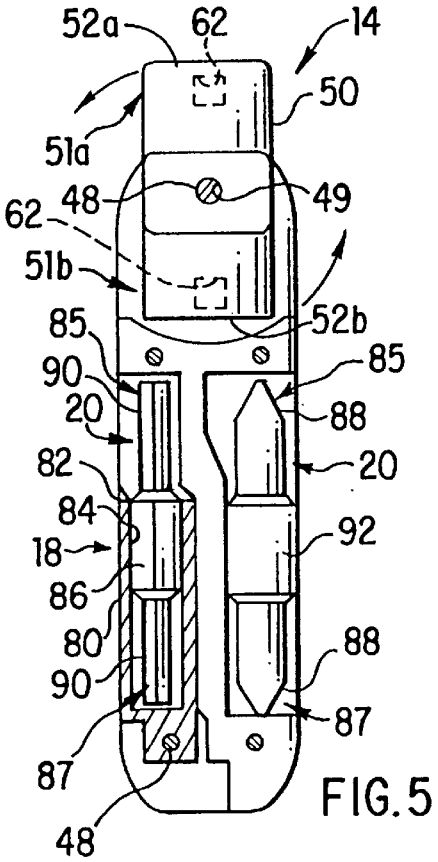
FIG. 5 is a cross-sectional view taken along the line V—V of FIG. 1.

Multi-purpose tool 10 further includes a preferably pivotably mounted bit driver 18. In a preferred embodiment, bit driver 18 is pivotably coupled to housing 12 via pivot pin 48 and is sized to be received in recess 38. Bit driver 18 preferably has a distal end 82 formed with an outwardly opening socket 84, as shown in FIG. 5. The exterior cross-section of bit driver 18 may be square, as shown, or any other convenient shape. The interior of bit driver 18 (i.e., socket 84) has a cross-section shaped to securely engage an element to which torque is to be applied, such as a nut, bolt, or bit shank. Socket 84 may be formed with a standard hexagonal cross-section to engage standard hexagonally shaped bit shanks. Socket 84 may have a predetermined dimension, for example 8 mm, selected for engaging a conventional sized nut, bolt, or other element to which torque is to be applied. Thus, socket 84 may also serve as a socket wrench for tightening and/or loosening purposes, in addition to being adapted to releasably receive and hold bits 20.

Bits 20 each include a hexagonal central shank 86 sized for making a close fit in bit socket 84 to be releasably nested therein. Bits 20 further include respective opposite ends 85, 87 which can be formed into various implements, such as a screwdriver 88 (either flathead or a Philips head, for example, a #2 and a #3 Philips head screwdriver), Allen type wrenches (or hex keys) 90 of various sizes (for example, 5⁄32 inch and 7⁄32 inch diameters), and the like. Bits 20 and/or bit driver 18 are preferably magnetized to enhance the engagement of bits 20 in bit socket 84 of bit driver 18. In one illustrative embodiment, multi-purpose tool 10 includes two bits 20, one of which is carried by bit driver 18 and the other of which is releasably received in bit holding recess 36. Tool housing 12 preferably includes a flexible, resilient bit holder 92, as shown in FIGS. 1 and 5, disposed at a predetermined location in recess 36 and configured to releasably engage bit 20 (e.g., in addition to the bit held by bit driver 18) in recess 36.

Figure 10:
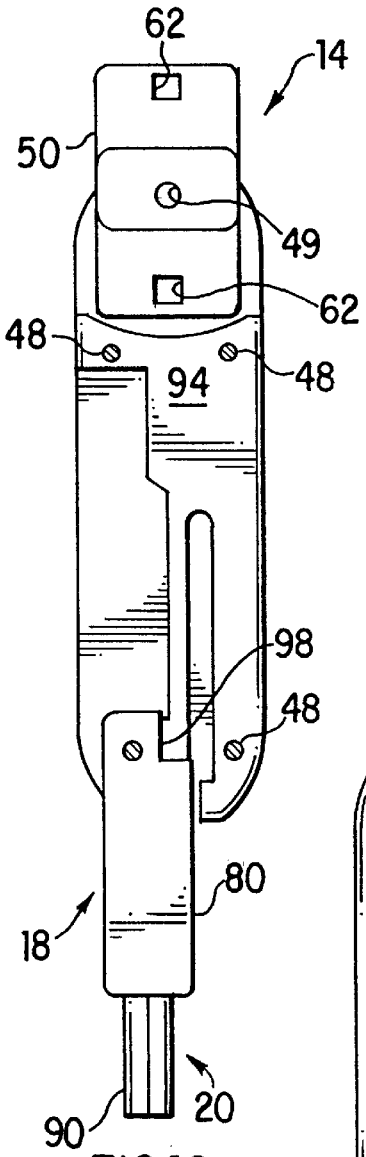
FIG. 10 is a cross-sectional view similar to that of FIG. 9, but with the drill holder in an extended, operating position.

Tool housing 12 further includes a bit driver spring plate 94 aligned with bit driver 18, as shown in FIG. 9. Bit driver spring plate 94 includes a spring arm 96 configured to releasably lock bit driver 18 in place in both the retracted and extended positions. Spring arm 96 is shaped to complement bit driver 18 and is operative to engage bit driver 18 and exert an outward force against the lower end of bit driver 18 to force it against pivot pin 48 to resist pivoting of bit driver 18 about pivot pin 48. When bit driver 18 is in the extended, operating position, spring arm 96 engages a notch 98 in the base of bit driver 18 and again forces bit driver socket 18 against pivot pin 48 to releasably lock bit driver 18 in place, as shown in FIG. 10.

Figure 11:
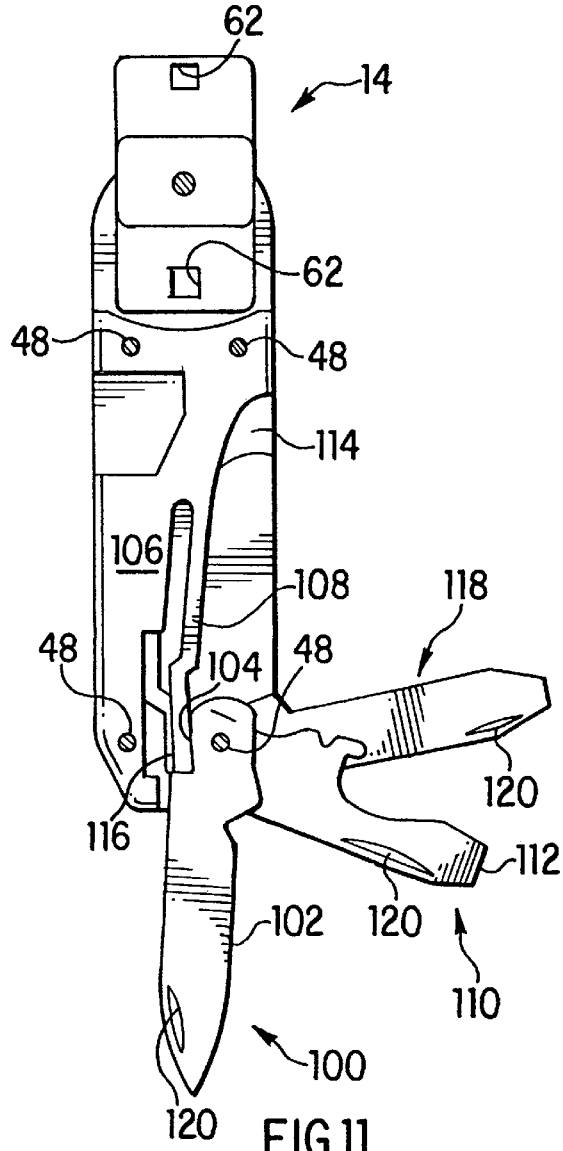
FIG. 11 is a cross-sectional view taken along the line XI—XI of FIG. 2.

In one preferred embodiment, multi-purpose tool 10 further includes a cutting tool 100 pivotably connected to one of rivets 48 for pivotable movement between a retracted, storage position in which cutting tool 100 is stored in recess 38, as shown in FIG. 2, and an extended, operating position with cutting tool 100 extended and preferably in-line with tool housing 12, as shown in FIG. 11. Cutting tool 100 includes a sharp edge defining a blade 102. Preferably, cutting tool 100 is further formed with a notch 104 in the base thereof to prevent further pivoting of the cutting tool 100 beyond 180° by engagement with a locking mechanism. The locking mechanism for cutting tool 100 may be in any desired form, such as a line lock spring as shown in FIG. 11. Cutting tool line lock spring 106 is contained within housing 12 and includes a spring arm 108 shaped to complement cutting tool 100 and operative to releasably lock cutting tool 100 in place in both the retracted and extended positions. Spring arm 108 operates in the same manner as bit driver spring arm 96 described above, namely by forcing cutting tool 100 against pivot pin 48 in both the retracted and extended positions. With cutting tool 100 in the operating position, the distal end of spring arm 108 is received in notch 104 of cutting tool 100 and prevents further pivoting of cutting tool 100. Thus, spring plate 106 and spring arm 108 may function as locking mechanisms for cutting tool 100. However, it will be appreciated that a variety of other locking mechanisms may be used instead.

In one embodiment, multi-purpose tool 10 includes a combination cap lifter and slot screwdriver 110, cap lifter 110 preferably being pivotably connected to tool housing 12 via pivot pin 48 (to which cutting tool 100 is connected) for pivoting between retracted and extended positions. Cap lifter 110 preferably is formed having a conventional shape to facilitate prying caps from bottles and the like. Cap lifter distal end 112 of cap lifter 10 is preferably configured to define a flat head screwdriver. Cap lifter line lock spring 114 is mounted inside tool housing 12, is aligned with cap lifter 110, and includes a spring arm 116 for releasably engaging cap lifter 110 to lock cap lifter 110 in either a retracted or extended position. Spring arm 116 operates in the same manner as spring arm 108. It will be appreciated that any other locking mechanism which releasably locks cap lifter 110 in a desired configuration may be used instead.

Multi-purpose tool 10 may also include an ice pick 118 pivotably coupled to the same pivot pin 48 which cutting tool 100 and cap lifter 110 are pivotably coupled for pivotable movement between a retracted, storage position within recess 38 and an extended, operating position. A distal end of ice pick 118 may be formed to function as a flat head screwdriver. An ice pick line lock spring 119, as shown in FIG. 2, is positioned within tool housing 12 and includes a resilient ice pick spring arm (not shown) to releasably lock ice pick 118 in place in the desired storage or operating position. It will be appreciated that any other locking mechanism which releasably locks ice pick 118 in a desired configuration may be used instead.

Each of cutting tool 100, cap lifter 110, and ice pick 118 is preferably formed with a recess 120 or another access-facilitating feature configured to facilitate grasping and manipulating of the respective implements to the respective extended, operating positions. For example, recess 120 may be shaped to receive a person's finger nail by which the tool may be grasped and pivoted out of its storage position.

While in the preferred embodiment cutting tool 100, cap lifter 110, ice pick 118, and bit driver 18 are pivotably connected to tool housing 12, it will be apparent that those tools could alternatively be slidably carried by tool housing 12 to travel along a linear path between retracted and extended positions.

Optionally, multi-purpose tool 10 may include a pair of tweezers 126 and a toothpick 128, each of which is slidably received within respective recesses 130 and 132 formed in the respective cover plates 22 and 24. Preferably, tweezers 126 and toothpick 128 are formed with enlarged cross-sections at respective upper ends sized to permit a tight fit with the respective recesses such that those implements may be securely yet releasably held in place in a respective recess.

Multi-purpose tool 10 preferably further includes respective backing plates 134 that abut against the respective front and back cover plates 22 and 24, as shown in FIGS. 1 and 8. With backing plates 134 in place against respective cover plates 22, 24, springs 64 and 72 are maintained in respective seats 65 and 74, and tweezers 126 and toothpick 128 are contained in the respective recesses 130 and 132. One or more spacer plates 136 preferably are included in tool housing 12, are aligned with bit driver 18, and are shaped to define recess 38 within tool housing 12 which accepts bit driver 18 therein.

Figure 13:
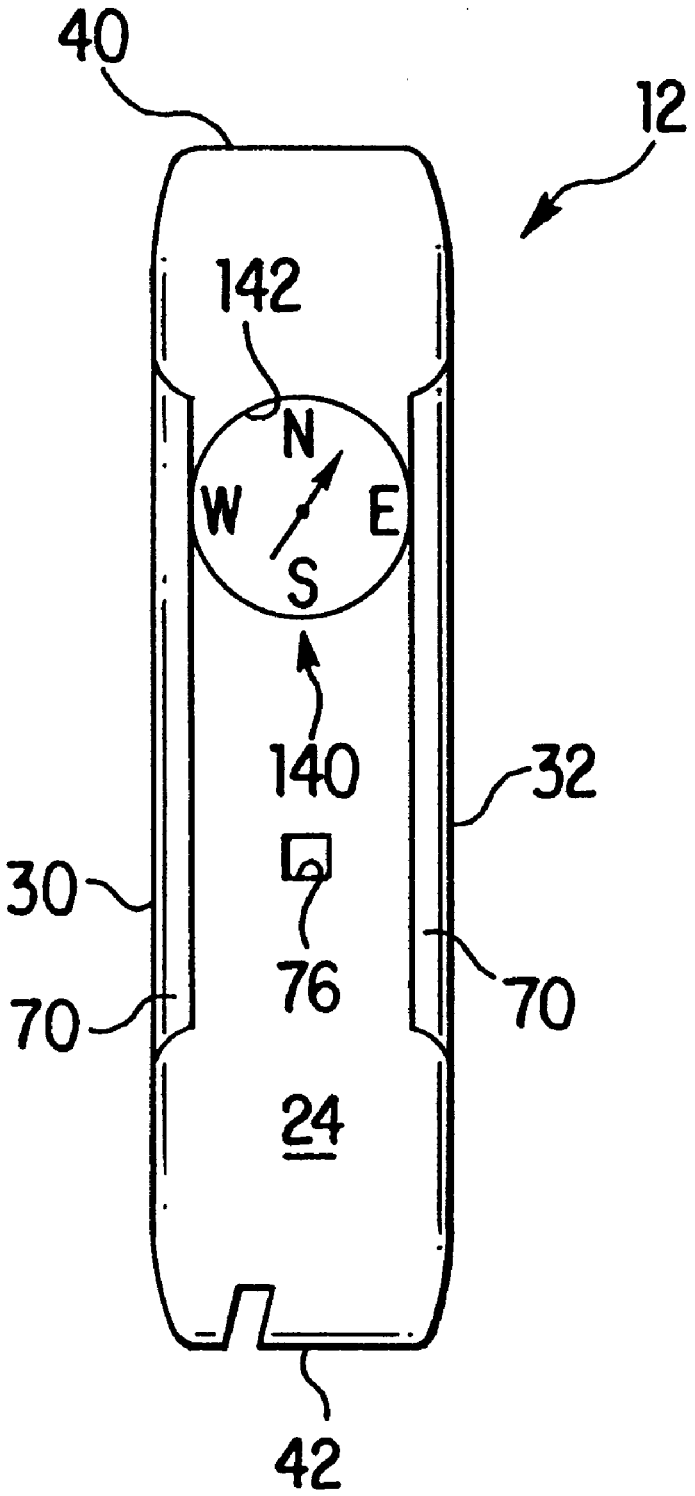
FIG. 13 is a back elevational view of another illustrative embodiment of the multipurpose tool formed in accordance with the principles of the present invention.

Referring now to FIG. 13, a direction determining device 140 may be included on a front (or back) side, such as in front or back cover plates 22, 24, of multi-purpose tool 10 of the present invention. In one embodiment, the direction determining device comprises a compass mounted in a recess 142 formed in one of cover plates 22, 24. The compass is situated in a convenient, accessible location on multi-purpose tool 10 for quick and easy viewing thereof. Compass 140 is especially helpful to, for example, a snowboarder who has become lost in a snowstorm with no other way of determining the direction in which he or she is traveling.

From the foregoing, it will be apparent that the multi-purpose tool 10 of the present invention provides a compact and convenient device including a number of implements often used to adjust sports equipment. It will be appreciated that the tools coupled to the multi-purpose tools described thus far may be modified in a variety of manners without departing from the scope and principles of the present invention.

A multi-purpose tool 210 formed in accordance with the principles of the present invention as described above but with various modifications to the tools coupled thereto is shown in FIGS. 14–18. Like multi-purpose tool 10 described above, multi-purpose tool 210 has a preferably compact, low-profile housing 212 formed with recesses configured to house various tools or implements useful for adjustments or repair of equipment used in sports described herein. Housing 212 preferably includes a front cover plate or scale 222 and a back cover plate or scale 224, each of which is preferably elongated, with a generally rectangular cross section. Preferably, a transverse plate 226, such as in the form of a U-channel, extends between cover plates 222, 224 to maintain cover plates 222, 224 in a spaced apart, aligned position. Respective plates 222, 224 of housing 212 are preferably joined together by spaced apart rivets 248 which extend through the respective plates. As with housing 12, some of the rivets not only hold the plates together but also serve as pivot pins on which various implements or tools may be pivotably mounted, as described below. Typically, the size of the rivets is selected based on the use of the rivet. Housing 212 also includes a pair of opposite ends 240 and 242 and a pair of opposite longitudinal sides 230 and 232. At least one side (side 230 in FIGS. 14 and 15) includes a longitudinal opening 234 leading to a storage recess 236 within housing 212 in which one or more implements or tools may be stored, as described in greater detail below.

An opposing recess 238 may be formed along the opposite side (side 232 in FIGS. 14 and 15) as well.

Figure 14:
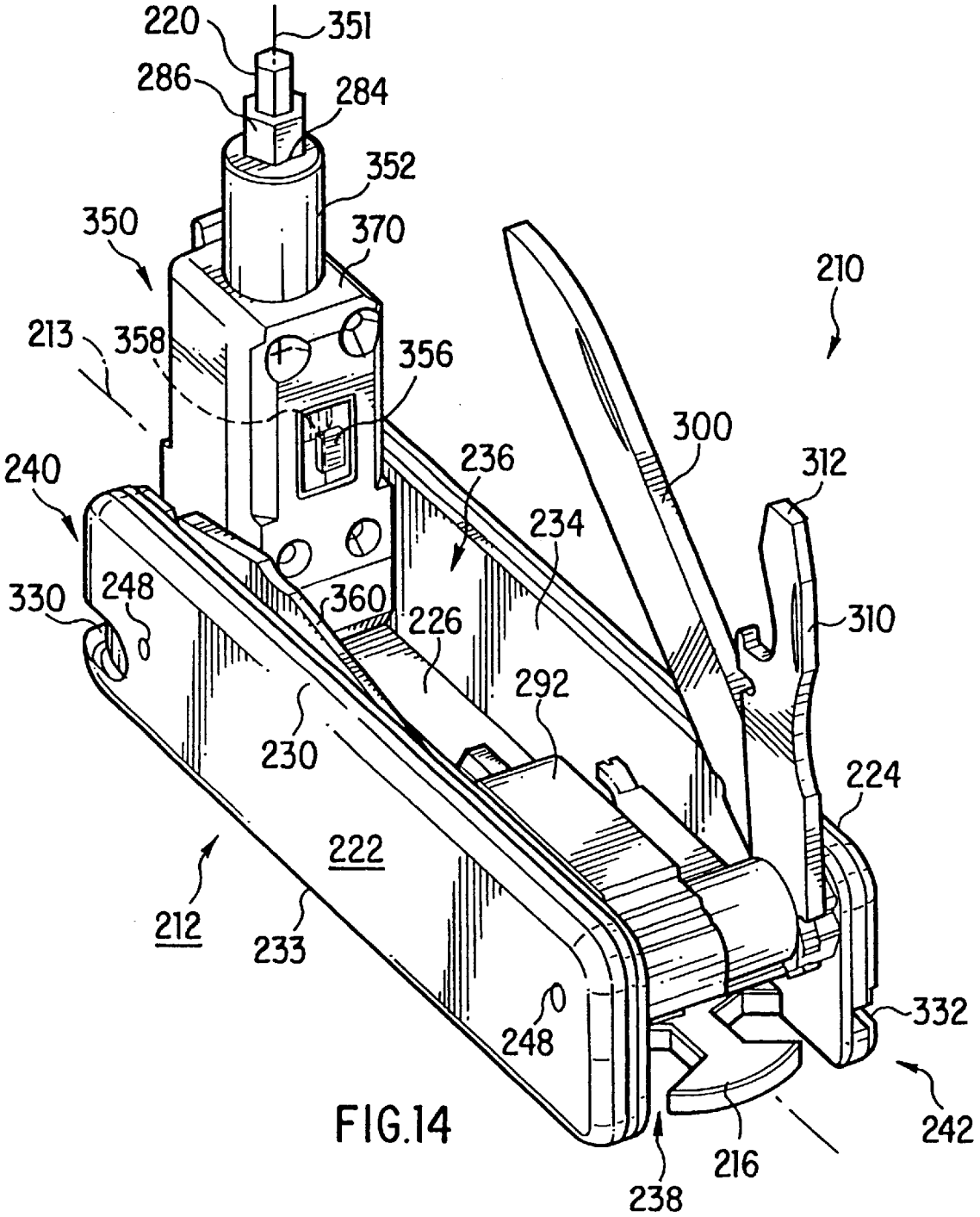
FIG. 14 is a perspective view of another illustrative embodiment of a multi-purpose tool formed in accordance with the principles of the present invention, with additional tools pivotably coupled to the housing of the multi-purpose tool shown in an extended position.
Figure 15:
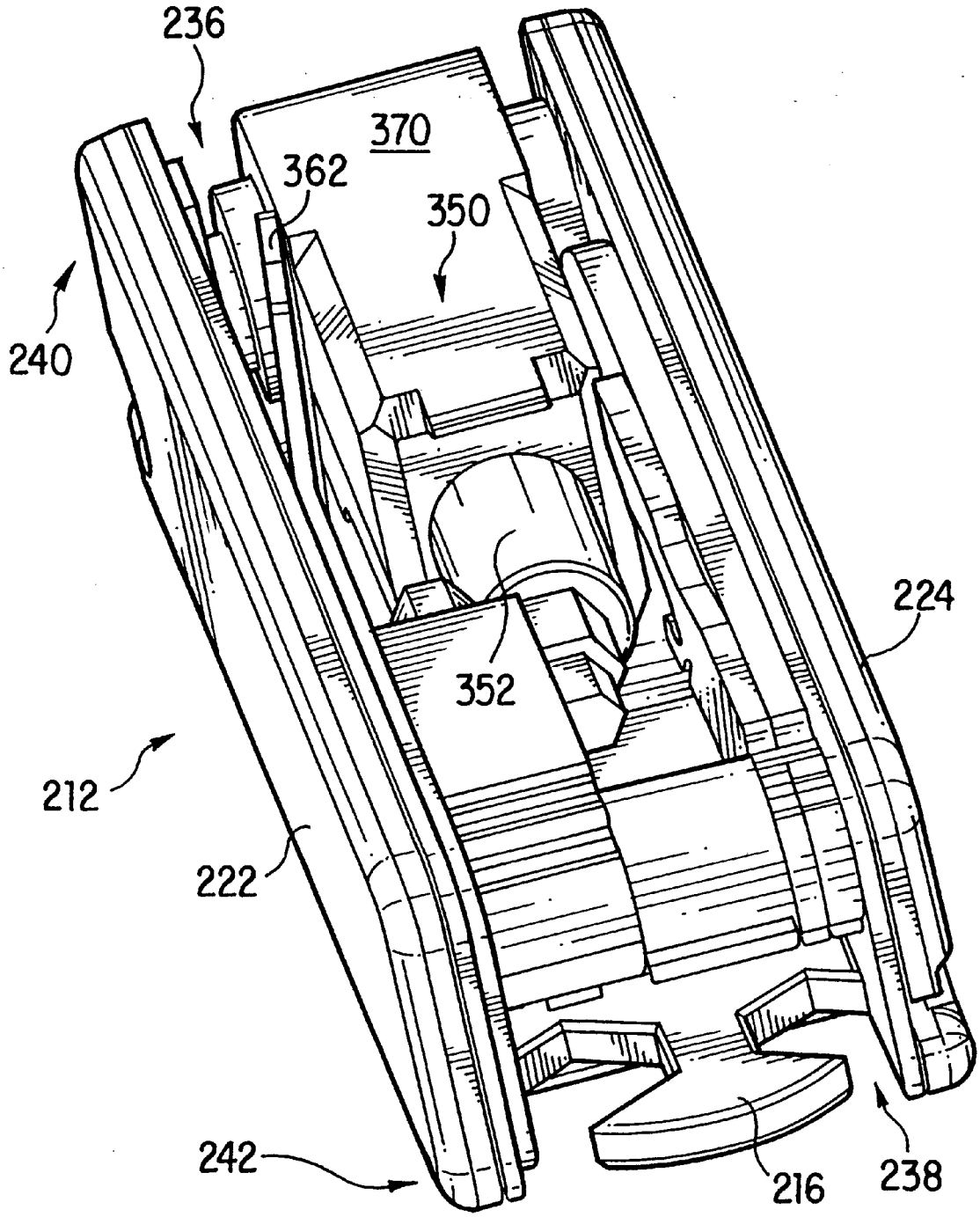
FIG. 15 is a perspective view of the multi-purpose tool of FIG. 14 with the additional tools in a storage position.
Figure 16:
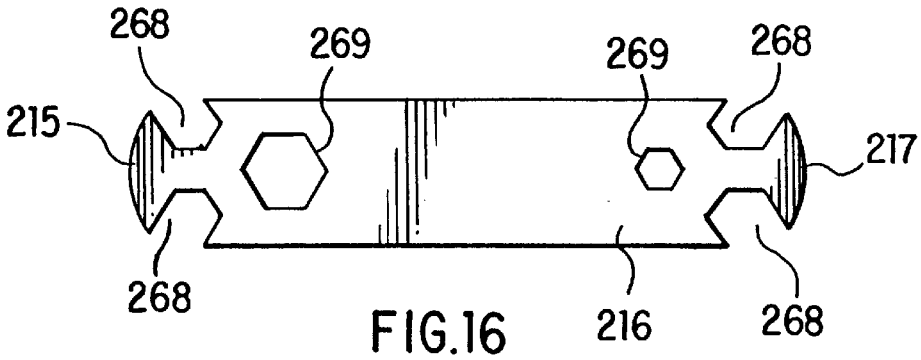
FIG. 16 is a plan view of a wrench bar which may be coupled to the multi-purpose tool of FIGS. 14 and 15.
Figure 17:
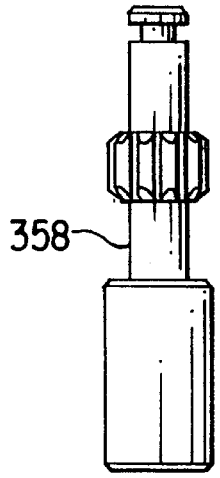
FIG. 17 is a side elevational view of a ratchet mechanism associated with the ratchet wrench of the multi-purpose tool of FIGS. 14 and 15.

Like multi-purpose tool 10, multi-purpose tool 210 preferably includes a variety of tools or implements which are pivotably coupled to at least one of rivets 248. As shown in FIG. 14, such pivotably mounted tools may include a cutting tool 300 and a cap lifter 310. Preferably, cap lifter distal end 312 is configured as a flat head screwdriver. The pivotably mounted tools are movable between a storage position, as shown in FIG. 15, and a working position, preferably aligned with the longitudinal axis 213 of housing 212, by extracting a selected tool from storage recess 336 as shown in FIG. 14. If desired, standard spring mechanism may be provided for the pivotably mounted tools to maintain the tool in the storage position when the tool is in storage recess 336, or in the working position when the tool has been extracted into a use position (typically substantially aligned with longitudinal axis 213 of housing 212).

Also like multi-purpose tool 10, multi-purpose tool 210 preferably includes a wrench bar 216. However, unlike wrench bar 16, each end 215, 217 of wrench bar 216 preferably is configured to include more than one open-ended wrench 268 defined along edges of wrench bar 216 as well a closed-sided wrench 269 within the boundaries of wrench bar 216. Thus, as may be appreciated with reference to FIG. 16, one end 215 of wrench bar 216 may include a first open-sided 8 mm wrench portion, a second open-sided 10 mm wrench portion, and a closed-sided 12 mm wrench portion. A second end 217 of wrench bar 216 may include a first open-ended ⅜ inch wrench portion, a second open-ended 7⁄16 inch wrench portion, and a closed-sided ¼ inch wrench portion. It will be appreciated that various other wrench portions, sized to function as differently sized wrenches, may be provided instead of or in addition to the wrench portions shown in FIG. 16.

Housing 212 includes a recess 238 configured to receive wrench bar 216 for storage therein. Recess 238 may be formed in any desired manner. For example, recess 238 may be formed by providing a rail along each side 230, 232 of housing 212 shaped to receive wrench bar 216. Preferably, a wrench bar retention mechanism is provided within recess 238 to retain wrench bar 216 within recess 238 until required for use. The wrench bar retention mechanism may be formed in any desired manner, such as at least one detent in one of recess 238 and wrench bar 216 and a corresponding receiver in the other of recess 238 and wrench bar 216.

Optionally, multi-purpose tool 210 includes a pair of tweezers and a toothpick each of which is slidably received within respective recesses 330 and 332 formed in respective cover plates 222 and 224. Preferably, the tweezers and toothpick are formed with enlarged cross-sections at respective upper ends sized to permit a tight fit with the respective recesses such that those implements may be securely yet releasably held in place in a respective recess.

In accordance with the principles of the present invention, multi-purpose tool 210 also includes a ratchet wrench 350 for use with sports equipment having such elements as nuts which must be tightened. Preferably, ratchet wrench 350 is pivotably coupled to tool housing 212 via one of rivets 248. In the embodiment shown in FIGS. 14 and 15, ratchet wrench 350 is coupled to one of ends 240, 242 (as shown, end 240) whereas above-described pivotably mounted tools 300, 310 are pivotably coupled to the other of ends 240, 242 (as shown, end 242). In order to make room for bit driver 352 of ratchet wrench 350 upon retraction of ratchet wrench into its storage position in storage recess 236, a spacer 354 may be provided on the end of multi-purpose tool 210 opposite the end on which ratchet wrench 350 is mounted and adjacent pivotably mounted tools 300, 310.

Bit driver 352 preferably has an interior similar to the interior of bit driver 18 of multi-purpose tool 10 formed into a socket 284 shaped to engage an element to which torque is to be applied, such as a nut, a bolt, or a bit shank, and to hold such element securely therein. Socket 284 may be formed with a predetermined dimension, for example 8 mm, for engaging a conventional sized nut or bolt. Thus, socket 284 may also serve as a socket wrench for tightening and/or loosening purposes, in addition to being adapted to releasably receive and hold a shank 286 of a bit 220. Preferably, a bit retention mechanism is provided within the interior of bit driver 352. For example, a detent ball may be provided within the interior of bit driver 352 biased radially inward for engaging a corresponding recess in the shank 286 of a selected bit 220. However, any other type of bit retention mechanism may be provided, such as by magnetizing bit driver 352 and bit 220.

Various bits 220 may be provided in accordance with the principles of the present invention. Preferably, one bit 220 is held in bit driver 352 when ratchet wrench 350 is in a storage position within storage recess 236 while at least one bit holder 292 is provided to retain an additional bit 220. Bit holder 292 preferably is pivotably coupled to the end of multi-purpose tool 210 opposite the end to which ratchet wrench 350 is pivotably coupled, as shown in FIGS. 14 and 15. An access-facilitating device, such as a recess, may be provided on the exterior of bit holder 292 to facilitate grasping of bit holder 292 for withdrawal from its retracted, storage position within storage recess 236. Preferably, at least two bits 220 are provided with multi-purpose tool 210. For example, the first bit may have a #2 Phillips head screwdriver on one end and a #3 Phillips head screwdriver on the opposite end. A second bit may have a 5⁄32 inch hex driver on one end and a 3 mm hex driver on the opposite end. It will be appreciated that a bit with other tool heads may be provided instead or in addition.

As common with ratchet wrenches, ratchet wrench 350 preferably is capable of being locked into a variety of functional positions. In particular, a sliding ratchet switch 356 is provided in the ratchet wrench 350 shown in FIG. 14 for positioning between a first position in which ratchet wrench 350 provides tightening force only in a clockwise position, a second position in which ratchet wrench 350 provides tightening force only in a counterclockwise position, and a third position in which ratchet wrench 350 provides tightening force in both directions (i.e., bit driver 352 is freely rotatable). Thus, a ratchet gear shaft 358, shown in FIG. 17, preferably is provided within ratchet wrench 350 coupled to switch 356 to control operation of ratchet wrench 350.

Figure 18:
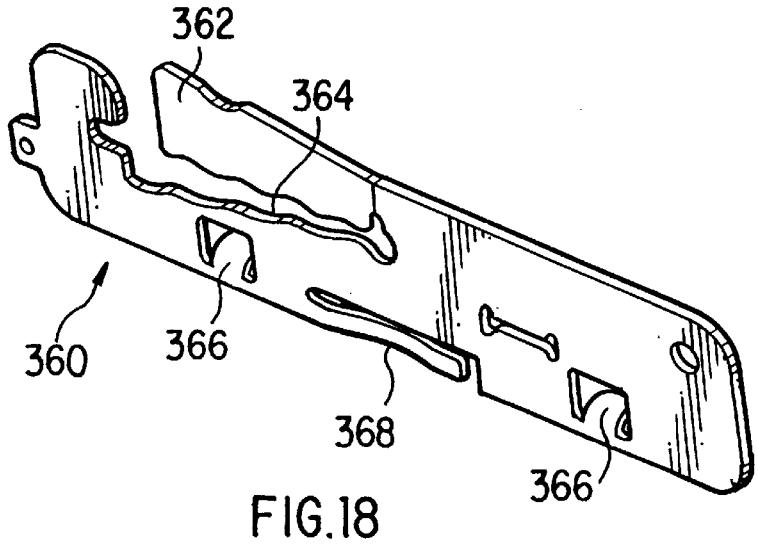
FIG. 18 is a perspective view of a ratchet wrench line lock spring for use in the multi-purpose tool of FIGS. 14 and 15.

Preferably, a ratchet wrench line lock spring 360, shown in isolation in FIG. 18, is provided to retain ratchet wrench 350 in a storage position when ratchet wrench 350 is within storage recess 336. Ratchet wrench line lock spring 360 preferably also functions to retain ratchet wrench 350 in a work position extracted from storage recess 336. Ratchet wrench line lock spring 360 may be in the form of a conventional line lock spring which substantially aligns with the tool to be locked, as will be understood by those of ordinary skill in the art. In accordance with a preferred embodiment, ratchet wrench line lock spring 360 has a locking finger 362 formed by providing a serpentine cut 364 along ratchet wrench line lock spring 360 as shown in FIG. 18. Serpentine cut 364 has been found to provide a configuration for line lock springs, generally, which prevents the line lock springs from interlocking with each other, such as when transported or further processed (e.g., polished) in bulk. Ratchet wrench line lock spring 360 may further include flanges 366 and fingers 368 shaped and positioned to support transverse plate 226 (FIG. 14).

In a preferred embodiment, the housing 370 of ratchet wrench 350 is configured to be engaged by ratchet wrench line lock spring 360 in one of two positions—a first position in which the longitudinal axis 351 of ratchet wrench 350 is substantially perpendicular to longitudinal axis 213 of tool housing 212 (as shown in FIG. 14) and a second position in which longitudinal axis 351 of ratchet wrench 350 is substantially aligned with longitudinal axis 213 of tool housing 212. If desired, additional locked positions may be provided by appropriate configurations of ratchet wrench 350.

While a multi-purpose tool formed in accordance with the principles of the present invention is particularly shown and described herein with reference to particular embodiments, it is to be understood that the invention may be used with many additions, substitutions, or modifications of form, structure, arrangement, proportions, materials, and components and otherwise, used in the practice of the invention, which are particularly adapted to specific environments and operative requirements without departing from the spirit and scope of the present invention. For instance, various other tools or other implements, such as an Allen Type, hex key-wrench or a clock or timing device, may be provided. The presently disclosed embodiments are therefore to be considered in all respects as illustrative and not restrictive, the scope of the invention being indicated by the appended claims, and not limited to the foregoing description.

What is claimed is:

1. A multi-purpose tool comprising:

a housing having a longitudinal axis;

at least one storage recess formed in said housing;

a ratchet wrench having a ratchet mechanism and a socket shaped to engage and transmit torque to an element to be rotated; and an additional tool coupled to said housing; wherein said ratchet wrench is pivotably coupled to said housing for movement between a storage position within said storage recess and an extended working position outside said storage recess.

2. A multi-purpose tool as in claim 1, wherein said additional tool comprises at least one tool selected from the group consisting of: a cutting tool, a screwdriver, a cap lifter, an ice pick, tweezers, a toothpick, a bit driver, and a wrench.

3. A multi-purpose tool as in claim 1, further comprising a direction determining device coupled to said housing.

4. A multi-purpose tool as in claim 1, further comprising a ratchet wrench locking mechanism positioned to engage said ratchet wrench to retain said ratchet wrench in said storage recess when said ratchet wrench is in said storage position and in an extended position when said ratchet wrench is in use in said working position.

5. A multi-purpose tool as in claim 4, wherein said ratchet wrench is shaped for engagement with said ratchet wrench locking mechanism in either a position perpendicular to said housing longitudinal axis or in a position substantially aligned with said housing longitudinal axis.

6. A multi-purpose tool as in claim 1, wherein said additional tool is pivotably coupled to said housing.

7. A multi-purpose tool as in claim 1, further comprising a ratchet switch selectively positionable between one of a plurality of positions to control the direction in which torque may be applied by said socket to the element.

8. A multi-purpose tool as in claim 6, wherein:

said additional tool is pivotably coupled to said housing for movement between a storage position within said storage recess and an extended working position outside said storage recess.

9. A multi-purpose tool as in claim 1, wherein said housing is formed with a recess configured to receive a bit.

10. A multi-purpose tool as in claim 1, wherein said socket is provided with a bit retention mechanism configured to retain a bit in said socket.

11. A multi-purpose tool as in claim 1, further comprising a bit holder coupled to said housing.

12. A multi-purpose tool as in claim 11, wherein said bit holder is pivotably coupled to said housing.

13. A multi-purpose tool as in claim 12, wherein:

said bit holder is pivotably coupled to said housing for movement between a storage position within said storage recess and an extended working position.

14. A multi-purpose tool as in claim 1, wherein said additional tool comprises a wrench bar coupled to said housing.

15. A multi-purpose tool as in claim 14, wherein:

a receptacle configured to receive said wrench bar therein is pivotably coupled to said housing for positioning between a storage position within said storage recess and an extended position in which said wrench bar is movable into and out of said receptacle.

16. A multi-purpose tool as in claim 14, wherein said wrench bar has first and second ends, each end having a plurality of wrench portions.

17. A multi-purpose tool as in claim 16, wherein said wrench portions include at least one open-ended wrench portion and at least one close-sided wrench portion.

18. A multi-purpose tool as in claim 13, wherein both said ratchet wrench and said bit holder are stored in the same storage recess.

* * * * *